US005749775A

United States Patent [19]

Fish

[11] Patent Number: 5,749,775

[45] Date of Patent: May 12, 1998

[54] DIAMOND BELT FOR CUTTING STONES

[76] Inventor: Donald D. Fish, 1212 K St., Bedford, Ind. 47421

[21] Appl. No.: 735,733

[22] Filed: Oct. 23, 1996

[30] Foreign Application Priority Data

Nov. 8, 1995 [IT] Italy ..... SV95A0025

[51] Int. Cl.[6] ..... B28D 1/08

[52] U.S. Cl. ..... 451/298; 451/296; 125/21

[58] Field of Search ..... 451/296, 298, 451/309, 355, 513, 529, 530, 552; 125/21, 22

[56] References Cited

U.S. PATENT DOCUMENTS

| | | | |
|---|---|---|---|
| 3,884,212 | 5/1975 | Armstrong et al. | 125/21 |
| 4,571,893 | 2/1986 | Braasch | 451/298 |
| 4,679,541 | 7/1987 | Fish . | |
| 4,739,745 | 4/1988 | Browning . | |
| 4,907,564 | 3/1990 | Sowa et al. | 125/21 |
| 4,971,022 | 11/1990 | Scott et al. | 125/22 |
| 5,181,503 | 1/1993 | Fish et al. . | |
| 5,216,999 | 6/1993 | Han | 125/21 |

FOREIGN PATENT DOCUMENTS

| | | |
|---|---|---|
| 0 320 456 | 6/1989 | European Pat. Off. . |
| 0 336 253 | 10/1989 | European Pat. Off. . |
| 0 527 344 | 2/1993 | European Pat. Off. . |
| 2 245 730 | 4/1974 | Germany . |

*Primary Examiner*—Eileen P. Morgan

*Attorney, Agent, or Firm*—Woodard, Emhardt, Naughton, Moriarty & McNett

[57] ABSTRACT

The invention relates to a diamond belt for cutting stones, like marble, granite, and others, generally used as an endless, that is continuous, belt, and characterized in that it has a flexible core, consisting of one or more cables (1), there being provided, slipped thereon through bores (2), rigid segments (3), generally made of metal, which are spaced and connected both to each other and to the flexible core (1), by incorporation in a flexible material, such as rubber or plastic, which forms the body (4) of the belt, filling the bores (2) of the rigid segments (3) and the intervals between them, and eventually covering the segments at least partially, the said segments (3) being provided with diamond surfaces, which project slightly above the body (4) of the belt, at least on its active front surface, facing the stone to be cut. Preferably, the diamond surface of each rigid segment (3) of the belt consists of a corresponding sintered diamond element, applied on the body of the rigid segment (3).

12 Claims, 3 Drawing Sheets

DIAMOND BELT FOR CUTTING STONES

The invention relates to a diamond belt for cutting stones, like marble, granite, and other, and aims at providing a belt of this type, having a strong and long-life construction, and being relatively cheap, still providing accuracy of cut even at high speeds, and thus allowing for a high productivity.

The diamond belt according to the invention, typically used as endless, that is continuous, belt, has a flexible core, consisting of one or more cables, there being provided, slipped thereon through bores, rigid segments, generally made of metal, which are spaced and connected both to each other and to the flexible core, by incorporation in a flexible material, such as rubber or plastic, which forms the body of the belt, filling the bores of the said segments and the intervals between them, and eventually covering the segments at least partially, the said segments being provided with diamond surfaces, which project slightly above the body of the belt, at least on its active front surface, facing the stone to be cut.

According to a preferred embodiment of the invention, the diamond surface of a rigid segment of the belt is made of a corresponding sintered diamond element, applied and fixed, particularly soldered, to the body of the rigid segment (3).

The term "sintered diamond element", used in accordance with the invention in the present description and in the appended claims, is meant to refer to a body made of a sintered material, in which the diamond particles or powder are incorporated (or embodied) by sintering.

The sintered diamond element may have—as seen in a cross sectional view of the belt—any profile and may be made, for example, of a plate with plane parallel faces, or may have a lying L or an inverted U profile, a portion of it being preferably housed in a corresponding notch of its respective segment.

According to another embodiment of the invention, the diamond surface of a rigid segment of the belt is made by directly charging with diamonds a corresponding area of said surface of the segment body.

In both cases, the diamond surface of each rigid segment of the belt may have any geometrical form and any extension. Thus, for example, in the simplest case, the diamond surface of a rigid segment of the belt may have a substantially rectangular shape, preferably extending over the whole width of the front active surface of the belt and to any extent in the longitudinal direction of the latter. In a preferred embodiment, the diamond surface of a rigid segment of the belt has, as seen in a top view of the active front surface of the belt—a L or T shape, with the L or T main stem orientated transversely with respect to the belt and preferably extending over the whole width of its active front surface, while the L base cross stem or the T top cross stem extend in the longitudinal direction of the belt, preferably coinciding with its longitudinal lateral edge. Preferably, in a particularly effective embodiment of the invention, the cross stems of the L or T shape of the diamond surface of the sequential rigid segments of the belt are alternately disposed at the opposite longitudinal edges of the belt itself.

According to another characteristic of the diamond belt provided in the invention, the individual rigid segments of the belt have diamond surfaces which project slightly above the body of the belt, even on at least one side of the belt, next to its active front surface and preferably in such a way as to form a portion of at least one of the longitudinal edges of said belt.

The idle rear side of the diamond belt, opposite to the active front surface of the belt itself, may have any profile and any construction. Particularly in machines, in which the endless diamond belt is guided on its idle rear side, opposite to the stone to be cut, into a guide groove of a belt-pressing member, the said idle rear side of the belt may be profiled so as to match and complement the said guide groove, in which it is slidingly engaged. Furthermore, in these cases, the rigid segments of the diamond belt according to the invention preferably have, accordingly, a profile which matches and complements that of the guide groove and may jut out, at least partially, from the rubber or plastic body of the belt on its idle rear side, in such a way as to interact with the delimiting walls of the said guide groove.

According to a further preferred characteristic of the invention, in order to facilitate the downflow of the washing and lubricating water and the discharge of the material removed form the stone on cutting, the diamond belt has on its active front surface, in coincidence with the intervals between the rigid segments, transverse grooves with their ends preferably connected to lateral grooves, which are placed in the belt sides, and extend on at least part of the height of the belt itself. Preferably, the lateral grooves provided in the same side of the belt are alternately inclined in opposite directions with respect to the longitudinal direction of the belt. The grooves provided in the two sides of the belt and connected to the same transverse groove are also preferably inclined in opposite directions with respect to the longitudinal direction of the belt itself.

The said characteristics, and others, of the invcention, and the advantages derived thereform, will appear in greater detail from the following description of some embodiments of the diamond belt according to the invention, schematically illustrated by way of non-limiting example in the annexed drawings, in which.

Figure 1:
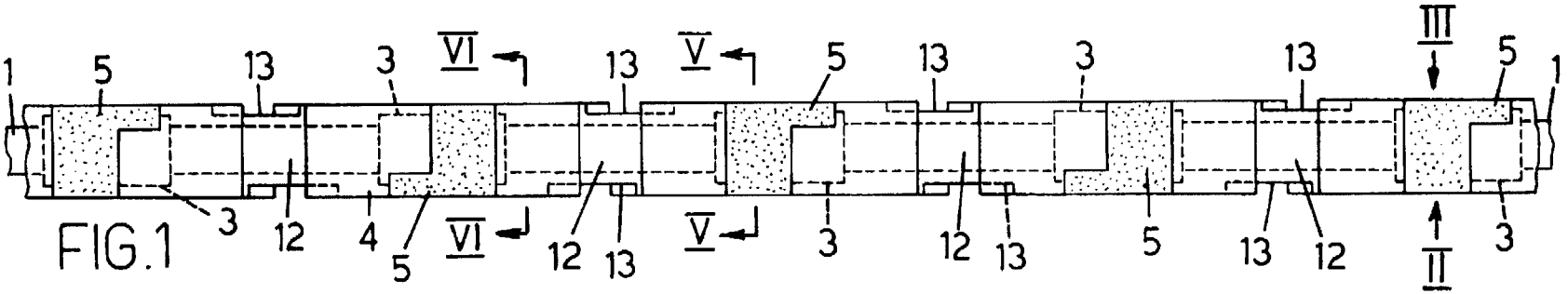
FIG. 1 shows a portion of the diamond belt according to the invention, as seen in its active front side view, facing the stone to be cut.
Figure 2:
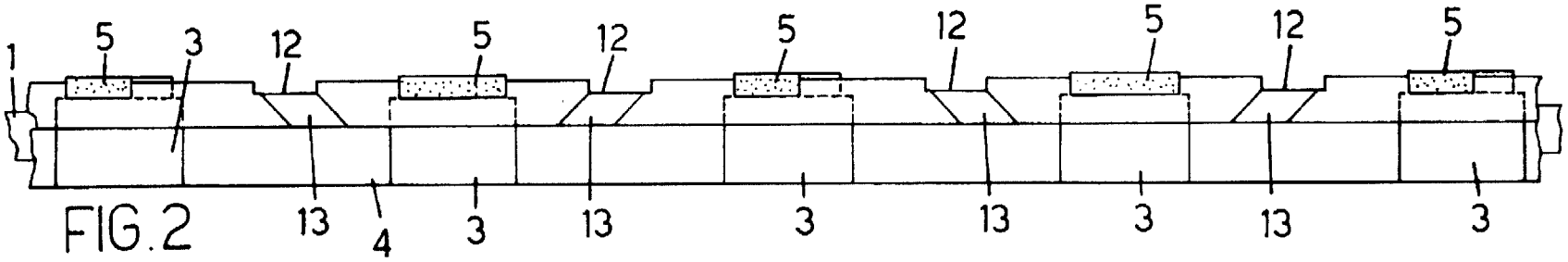
FIGS. 2 and 3 show the same portion of the diamond belt, as seen in two side views of opposite sides according to the arrows II and III of FIG. 1.
Figure 3:
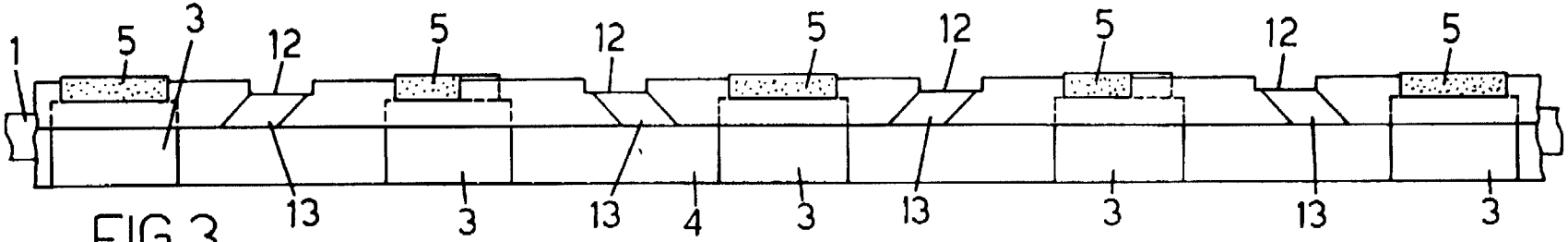
Figures 4, 5, 6, 7, 7A, 8:
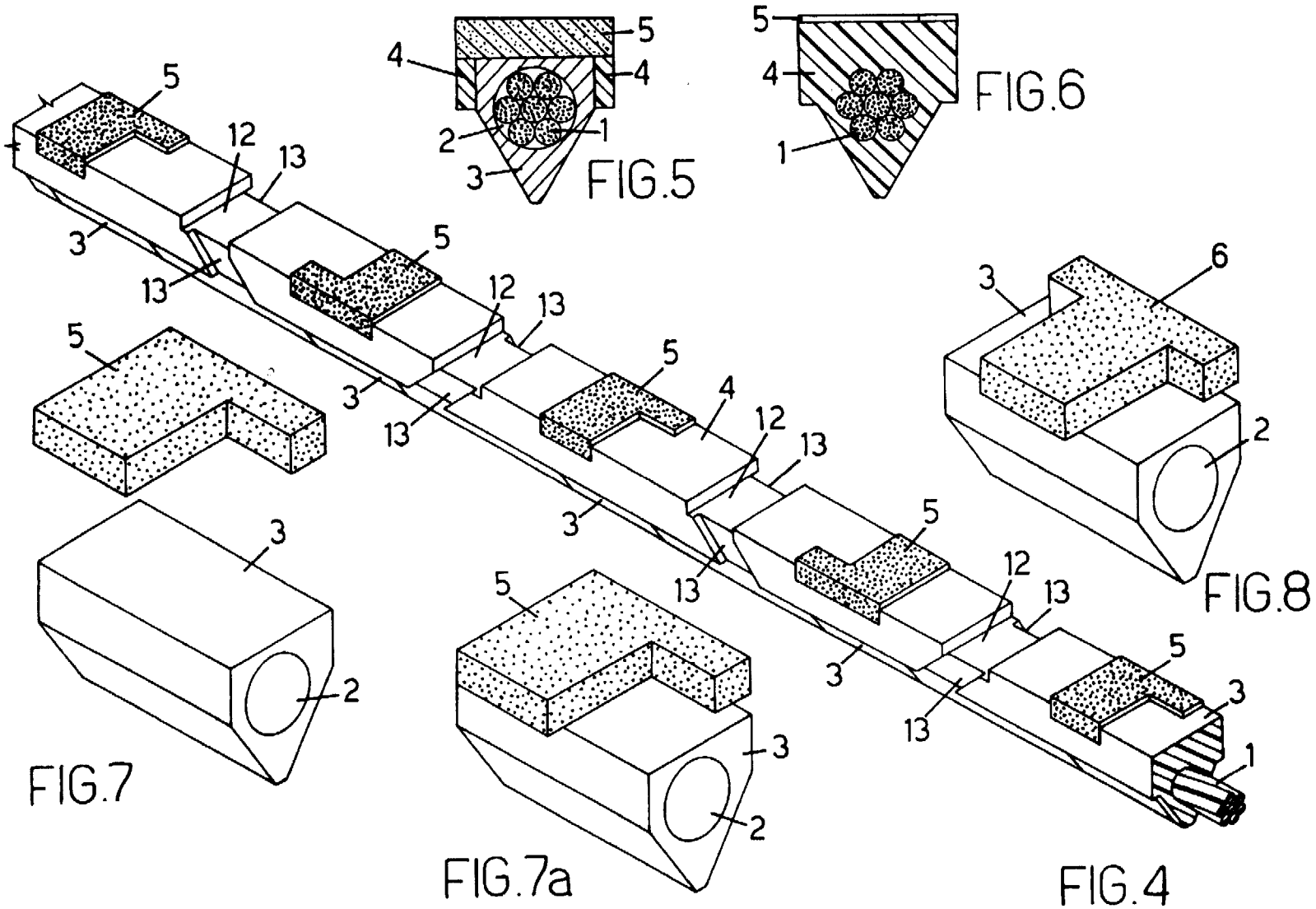
FIG. 4 is a perspective view of the portion of the diamond belt according to FIGS. 1 to 3.
FIGS. 5 and 6 are two slightly enlarged cross sectional views of the diamond belt according to lines V—V and VI—VI of FIG. 1.

FIGS. 7, and 7*a* are perspective and more enlarged views of a rigid segment of the belt according to FIGS. 1 to 6, prior to the application of a sintered diamond element (FIG. 7) and thereafter (FIG. 7*a*).

FIG. 8, is a perspective view of a variant embodiment of a rigid segment of the belt, provided with a sintered diamond element.

Figure 9:
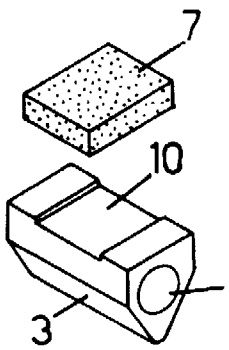
Figure 9A:
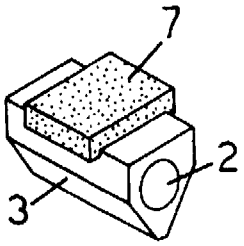
Figure 10:
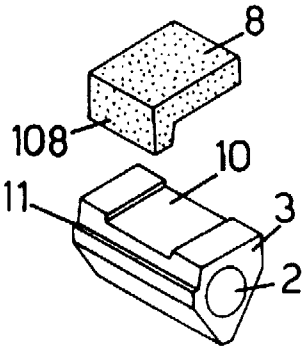
Figure 10A:
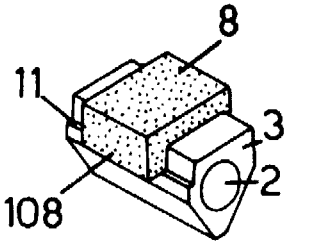
Figure 11:
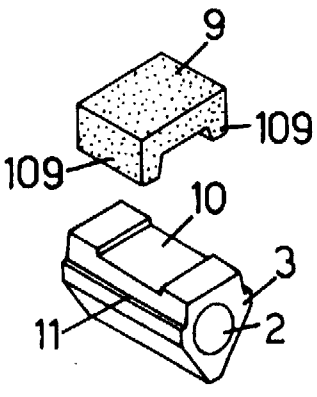
Figure 11A:
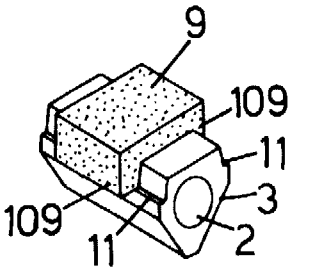

FIGS. 9, 9*a*; 10, 10*a* and 11, 11*a*, are perspective views of three variant embodiments of a rigid segment of the diamond belt according to the invention, each time prior to application of the sintered diamond element (FIGS. 9, 10, and 11) and thereafter (FIGS. 9*a*, 10*a*, and 11*a*).

Figure 12:
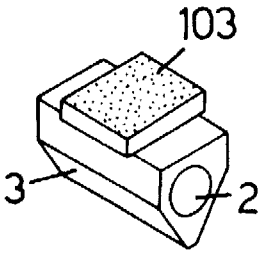

FIG. 12 is a perspective view of another embodiment of a rigid segment of the diamond belt.

Figure 13:
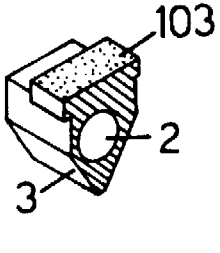

FIG. 13 is a perspective cross sectional view of the rigid segment according to FIG. 12.

Referring to FIGS. 1–7*a*, the diamond belt according to the invention is intended for cutting stones, like marble, granite, and others, and comprises a flexible core 1, consisting of one or more cables, which are generally made of metal, but may also be made of a suitable plastic material. On this flexible core 1 there are provided, slipped through corresponding longitudinal bores 2, rigid segments 3, which are generally made of metal, but may be also made of a suitable plastic material. The rigid segments 3 are regularly spaced and connected both to each other and to the flexible core 1, by incorporation with a mass of flexible material, such as rubber or plastic, which forms the body 4 of the belt, and fills both the bores 2 of the rigid segments 3 and the intervals between them.

The active front side of the diamond belt, that is the side facing the stone to be cut, and shown as top view in FIGS. 2 to 13, is substantially plane, whereas the opposite idle rear side, orientated downwards in FIGS. 2 to 13, and generally intended for sliding engagement in a guide groove of a belt-pressing member, is profiled in such a way as to match and complement the said guide groove and has, for example, as in the illustrated case, a V profile. The individual rigid segments 3 of the belt have the same profile. Preferably, these rigid segments 3 jut out from the rubber or plastic body 4 of the belt on its two sides in coincidence with the inclined surfaces of its V-shaped portion, so as to interact directly with the corresponding surfaces of the guide groove, profiled accordingly.

On the side corresponding to the active front surface of the belt, that is on the side facing the stone to be cut, and made to be substantially plane, the rigid segments 3 have a diamond surface which slightly projects above the rubber or plastic body 4 of the belt.

At this end, according to a possible embodiment of the invention, illustrated in FIGS. 12 and 13, the rigid segment 3 is made of metal and provided with an integral plate-like extension 103, jutting out from the rubber or plastic body 4 of the belt, on the active front side of the latter. The outer surface of the said extension 103, which is substantially plane and projects slightly out of that of the active front side of the belt, is directly diamond-charged through processes that are well-known to those skilled in the art.

According to another preferred embodiment of the invention, illustrated in FIGS. 1 to 11*a*, the diamond surface of a rigid metallic segment 3 of the belt is made of a sintered diamond element 6, 7, 8, 9, which is applied and fixed, and particularly soldered, preferably through induction soldering, on the side of the respective segment 3, facing the stone to be cut, the said sintered diamond element projecting laterally out of the rubber or plastic body of the belt.

In the embodiment according to FIGS. 1 to 7*a*, the sintered diamond element 5 is made of a L-shaped plate, which is orientated in such a way, that the L main stem extends transversely with respect to the longitudinal direction of the belt, over its whole width, whereas the L cross stem extends in the longitudinal direction of the belt, in coincidence with one of its lateral edges. The sintered diamond L-shaped plates 5 of the sequential segments 3 of the belt are alternately and specularly inverted, so that the L cross stems come to coincide alternately with the opposite longitudinal edges of the belt and are alternately orientated in opposite longitudinal directions, as evidently shown in FIGS. 1 and 4.

In the embodiment according to FIG. 8, the sintered diamond plate 6, applied on the metal segment 3 of the belt, has a T shape, with the T main stem orientated transversely with respect to the belt and extending over its whole width, while the T top cross stem extends in the longitudinal direction of the belt, in coincidence with one of its lateral edges. In this case too, the T-shaped sintered diamond plates 6 of the sequential segments 3 of the belt may be preferably alternately inverted, that is turned 180°, so that the T cross stems correspond alternately with the opposite longitudinal lateral sides of the belt.

In the embodiments according to FIGS. 9 to 11*a*, the sintered diamond elements 7, 8 and 9, applied and soldered on the metallic body of the rigid segments 3 of the belt, have—as seen in a top view on the active front side of the belt—a rectangular or square shape, extending on the whole width of the belt itself. In the embodiment according to FIGS. 9 and 9*a*, the sintered diamond element is made of a plate 7 with plane parallel faces, having a portion of its width housed in a corresponding transverse groove 10 of the segment 3. In the embodiment according to FIGS. 10 and 10*a*, the sintered diamond element applied 8 has, as seen in a cross sectional view of the belt, a L profile. This L-profiled element has also the L main stem partially housed in a trasverse groove 10 of the segment 3, whereas the tongue 108, formed by the L base cross stem, extends on one side of the segment 3 and rests on a lateral longitudinal step 11 of the segment 3 itself. The L-profiled sintered diamond elements 8 of the sequential segments 3 of the belt bay be alternately inverted, that is turned 180°, in such a way that their tongues come to coincide alternately with opposite sides of said belt. In the embodiment according to FIGS. 11 and 11*a*, the sintered diamond element 9 has, as seen in a cross sectional view of the belt, an inverted U shape, whose cross stem has one portion of its thickness housed in a transverse groove 10 of the segment 3, while its two tongues 109 extend on the sides of the segment 3, until they come to rest each on a corresponding lateral longitudinal step 11 of said segment.

As evidently shown in all FIGS. 1 to 11*a*, the sintered diamond elements 5, 6, 7, 8 and 9, applied and soldered on the metallic segments 3 of the belt, jut out and project above the rubber or plastic body 4 of the belt not only on the substantially plane active front surface of said belt, but also on at least one and preferably both sides of the belt, forming a portion of the edge of the corresponding longitudinal side or sides of the belt itself.

On the active front side of the diamond belt, that is on the side facing the stone to be cut, between the individual rigid segments 3 of the rubber or plastic body 4 of the belt, there are provided transverse grooves 12 communicating each with two lateral grooves 13, provided in the sides of the rubber or plastic body 4 of the belt. The lateral grooves 13 extend on their respective sides of the belt towards its idle rear side, particularly up to the base of the V-profiled portion and are inclined with respect to the longitudinal direction of the belt. Particularly, the two lateral grooves 13 associated to each transverse groove 12 are inclined in opposite longitudinal directions of the belt, whereas the sequential lateral grooves provided on the same side of the belt are alternately inclined in the opposite directions, as apparent in FIGS. 1 to 4. The above described system of grooves 12 and 13 is especially intended for the discharge of water and of the material removed from the stone on cutting by the diamond belt.

Naturally, the invention is not limited to the embodiments described hereinbefore and illustrated in the annexed drawings, but may be greatly varied and modified, particularly within the range of all technical equivalents, without departure from the guiding principle disclosed above and claimed below.

I claim:

1. An endless and continuous diamond belt for cutting stones, said belt having a flexible core with a main body with length and a first side and an opposite second side and comprising:

a least one cable;

a plurality of rigid metal segments with bores through which said cable extends, said segments spaced apart along said cable forming intervals between segments;

a flexible material forming the main body and extending into said bores of said rigid segments and said intervals holding said segments together and to said cable, said flexible material at least partially covering said segments; and wherein:

said segments having sintered diamond elements projecting above said flexible material and outwardly from the main body facing the stone to be cut, said elements having profiles with main stems and tongues connected together with said main stems extending transversely atop and from said first side to said opposite second side across the main body and said tongues extending downwardly therefrom adjacent the first side and the opposite second side, said tongues extend longitudinally from said main stems along the length of the main body in alternate directions, said main body having transverse and lateral grooves.

2. The belt of claim 1 wherein:

said elements have L shaped profiles with said profiles having bases formed by said tongues and located alternatively adjacent the first side and the opposite second side.

3. The belt of claim 1 wherein:

said elements are each one piece constructions.

4. The belt of claim 3 wherein:

said tongues extend from said main stems longitudinally along the length of the main belt in alternate directions atop the belt and adjacent said first side and said opposite second side.

5. The belt of claim 4 wherein:

said segments have mounting grooves extending thereatop transverse to the length of the main body receiving said main stems of said elements.

6. The belt of claim 4 wherein:

said transverse grooves extending thereacross and said lateral grooves extending from said transverse grooves on said first side and said opposite second side forming water channels, said lateral, grooves being alternatively inclined in opposite directions along the length of the belt.

7. The belt of claim 1 wherein:

said elements have T shaped profiles.

8. An endless and continuous diamond belt for cutting stones, said belt having a flexible core with a main body with length and a first side and an opposite second side and comprising:

a least one cable;

plurality of rigid metal segments with bores through which said cable extends, said segments spaced apart along said cable forming intervals between segments;

a flexible material forming the main body and extending into said bores of said rigid segments and said intervals holding said segments together and to said cable, said flexible material at least partially covering said segments; and wherein:

said segments having sintered diamond portions projecting above said flexible material and outwardly from said main body facing the stone to be cut, said portions having non-cylindrical cross sectional profiles with said profiles having main stems and tongues connected together with said main stems extending transversely atop and across the main body and said tongues extending downwardly therefrom adjacent the first side and the opposite second side, said main body has transverse grooves extending thereacross and lateral grooves extending from said transverse grooves on said first side forming water channels, said lateral grooves being alternatively inclined in opposite directions along the length of the belt.

9. The belt of claim 8 wherein:

said lateral grooves are arranged in pairs and are located on said first side and said opposite second side with lateral grooves in said pairs aligned with said transverse grooves and inclined in opposite directions on said first side and said opposite second side along the length of the belt.

10. The belt of claim 8 wherein:

said sintered diamond portions are induction soldered thereto.

11. The belt of claim 8 wherein:

said sintered diamond portions are plates with plane parallel faces.

12. The belt of claim 8 wherein:

said sintered diamond portions including a L profile and having a main stem extending transversely across the main body and further having a base cross stem extending on the first side.

* * * * *